US005205451A

United States Patent [19]

Manzer

[11] Patent Number: 5,205,451

[45] Date of Patent: Apr. 27, 1993

[54] INFANT CARRIER

[76] Inventor: Donna S. Manzer, 108 Hidden Glen Ln., Montvale, Va. 24122

[21] Appl. No.: 826,386

[22] Filed: Jan. 27, 1992

[51] Int. Cl.[5] ..... A61G 1/00

[52] U.S. Cl. ..... 224/161; 224/209; 224/259

[58] Field of Search ..... 224/151, 155, 158, 159, 224/160, 161, 209, 215, 257, 258, 259, 262; 297/464, 465, 467, 468; D3/31

[56] References Cited

U.S. PATENT DOCUMENTS

| | | | |
|---|---|---|---|
| D. 138,791 | 9/1944 | Horckitz | D3/31 |
| D. 176,068 | 11/1955 | Johnson | D3/31 |
| D. 255,180 | 6/1980 | Raz | D3/31 |
| D. 294,429 | 3/1988 | Vasquez | D3/31 |
| 2,477,164 | 7/1949 | Bergman | 224/159 |
| 2,496,216 | 1/1950 | Kaminski | 224/159 |
| 2,537,864 | 1/1951 | Skaer | 224/159 |
| 4,149,687 | 4/1979 | Nunemacher | 224/159 |
| 4,271,998 | 6/1981 | Ruggiano | 224/160 |
| 4,428,514 | 1/1984 | Elf | 224/151 |
| 4,469,259 | 9/1984 | Krich et al. | 224/160 |
| 4,487,346 | 12/1984 | Fischer, Jr. | 224/160 |
| 4,724,988 | 2/1988 | Tucker | 224/160 |
| 4,778,091 | 10/1988 | Barto | 224/158 X |
| 4,941,604 | 7/1990 | Nagareda | 224/160 |
| 5,020,709 | 6/1991 | Hoaglan | 224/151 |

FOREIGN PATENT DOCUMENTS

| | | | |
|---|---|---|---|
| 574757 | 1/1946 | United Kingdom | 224/158 |
| 618269 | 2/1949 | United Kingdom | 224/159 |
| 678225 | 8/1952 | United Kingdom | 224/160 |

OTHER PUBLICATIONS

American Motorist Magazine, Nov. 1957, p. 18 "What's This? A Human Male Kangaroo?"

*Primary Examiner*—Henry J. Recla
*Assistant Examiner*—Glenn T. Barrett
*Attorney, Agent, or Firm*—Richard C. Litman

[57] ABSTRACT

An infant carrier is disclosed which provides for the forward facing carriage of an infant or small child at the front of an adult. The carrier provides several improvements in security for the infant over the prior art, such as positive latching buckles for securing the various straps around both the adult and infant in order to preclude slippage of the straps. The carrier in its assembled state also provides a five way restraint system for the infant, comprised of two infant restraining straps, two lateral restraints, and a forward restraint extending from the front of the seat. Padding is also included for the seat portion of the device and also for the various straps in order to provide greater comfort for the adult carrying the infant in the carrier and also to preclude chafing or other injury to an infant carried in the carrier due to the edges of restraining straps or other portions.

6 Claims, 3 Drawing Sheets

INFANT CARRIER

FIELD OF THE INVENTION

This invention relates generally to devices providing for the hands free carriage of an infant by an adult, and more specifically to such a carrier which allows the infant to be carried in front of the adult and facing forward, and further provides substantial security for the infant.

BACKGROUND OF THE INVENTION

While it is well known that infants and small children require relatively large amounts of time and attention, parents are typically finding increasing demands upon their time. It has become more and more difficult to devote time to an infant or child when it is common for both parents to work, and additionally to shop and perform other necessary errands and chores to support a household. Further, a single parent household has become a relatively common occurrence, and such a single parent finds even less time to devote to the care of an infant or small child due to the lack of another parent with which to share various chores. In response to the above problems, various devices have been developed which provide for the hands free carriage of an infant or small child by an adult, thereby allowing the adult to perform routine chores while still caring for the infant.

Insofar as infants and small children are concerned, it has become generally accepted that the greater the intellectual stimulation for such a child, the better for the child. While various devices are known which permit a parent to carry an infant or small child, particularly in a position in front of the parent in order to achieve better emotional security for the child, in many cases it may be preferable for the child to face forward in order to begin to develop skills for interaction with the World at large. However, the typical infant carrier does not permit the infant to face away from the adult carrying the infant, and those that do typically carry the infant on the back of the adult where the adult cannot readily monitor the condition of the infant. While infant carriers providing for the forward facing carriage of an infant in front of an adult are known, such carriers fail to provide the necessary security for the carried infant or small child.

The need arises for a carrier for infants or small children, which carrier places the child in front of the adult carrying the infant. The carrier must also be capable of carrying the child so the child faces forward, and moreover must provide adequate security for the child carried therein.

DESCRIPTION OF THE RELATED ART

R. A. Nunemacher U.S. Pat. No. 4,149,687 discloses a Baby Pouch which provides for the forward facing carriage of an infant in front of an adult. The device is suspended from the back of the adult's neck, rather than over the shoulders, which neck suspension is relatively tiring for an adult carrying an infant in such a carrier.

J. L. Elf U.S. Pat. No. 4,428,514 discloses an Infant Carrier providing for carriage of an infant generally in the manner of the present invention and of the device of the patent issued to Nunemacher discussed above. However, no provision is made to prevent an infant from slipping from the open side of the device, other than the straps which suspend the front of the carrier and pass to either side of the child's neck. Moreover, the D ring adjustments provided are prone to slippage, particularly if the weight is momentarily removed as by partially lifting the child from the carrier, thus failing to provide the desired security. No padding is disclosed either for the child seat portion or for the shoulder straps, thus rendering the device relatively uncomfortable, and the lack of padding on the straps to either side of the child's neck could allow some chafing to occur.

C. A. Krich et al. U.S. Pat. No. 4,469,259 discloses a Baby Carrier providing for the carriage of a small child or infant in front of an adult and facing the adult. An alternate embodiment provides for the forward facing carriage of the child. In order to provide such versatility, the device is relatively complex, requiring a total of six straps passing at least partially around the adult user.

B. B. Fischer, Jr. U.S. Pat. No. 4,487,346 discloses an Infant Sling-Type Carrier, which device provides a saddle like seat and a single underarm retaining strap for the child. Thus, the child is carried somewhat sideways relative to the adult, and moreover the single main shoulder strap provides for asymmetrical positioning of the child. The finite adjustment means provided further limits the device.

A. M. Hoaglan U.S. Pat. No. 5,020,709 discloses a Convertible Child Carrier which may be used as a front carrier or on a rigid frame as a back carrier. The child must always face the adult when this device is used, and moreover the device is relatively bulky in comparison to the present invention due to the provision for a rigid frame and other features.

E. S. Raz U.S. Pat. No. D-255,180 and M. E. Vasquez U.S. Pat. No. D-294,429 respectively disclose designs for an Infant Carrier and a Baby Carrier. No function is disclosed by these designs.

None of the above noted patents, either singly or in combination, are seen to disclose the specific arrangement of concepts disclosed by the present invention.

SUMMARY OF THE INVENTION

By the present invention, an improved carrier for infants and small children is disclosed.

Accordingly, one of the objects of the present invention is to provide an improved infant carrier which allows the infant to be carried to the front of the adult supporting the carrier.

Another of the objects of the present invention is to provide an improved infant carrier which allows the carried infant to face forward.

Yet another of the objects of the present invention is to provide an improved infant carrier which provides for greater comfort for both infant and adult users by means of padded or upholstered straps and infant seat.

Still another of the objects of the present invention is to provide an improved infant carrier which provides for infinite adjustability of each of the carrying straps.

A further object of the present invention is to provide an improved infant carrier which provides for greater security for the infant due to the positive securing of the strap ends by means of positive securing buckles.

An additional object of the present invention is to provide an improved infant carrier which provides greater security for the infant by means of a lateral enclosure which wraps around the sides of the infant contained in the carrier.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
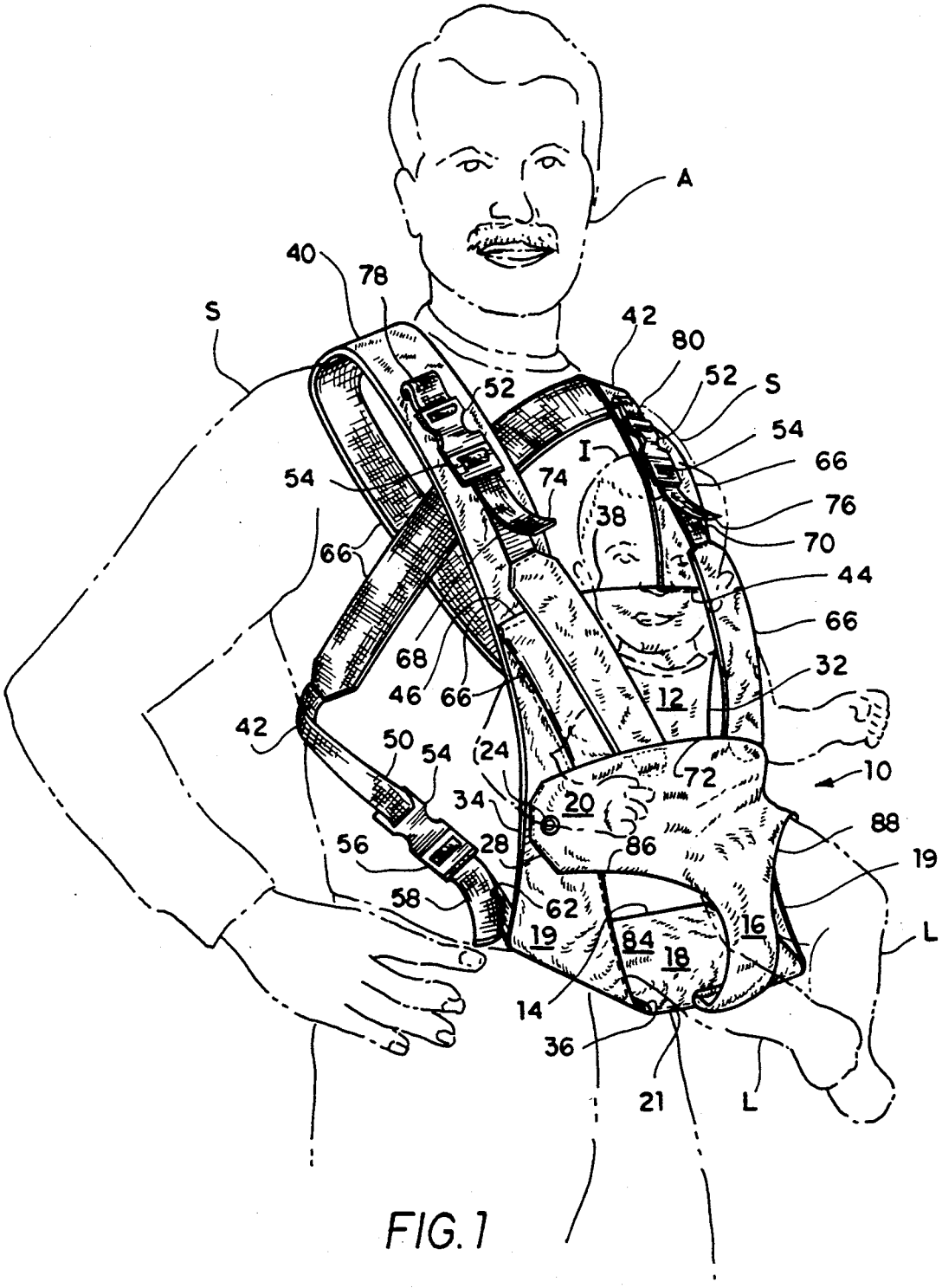
FIG. 1 is a front perspective view of the infant carrier of the present invention in use.
Figure 2:
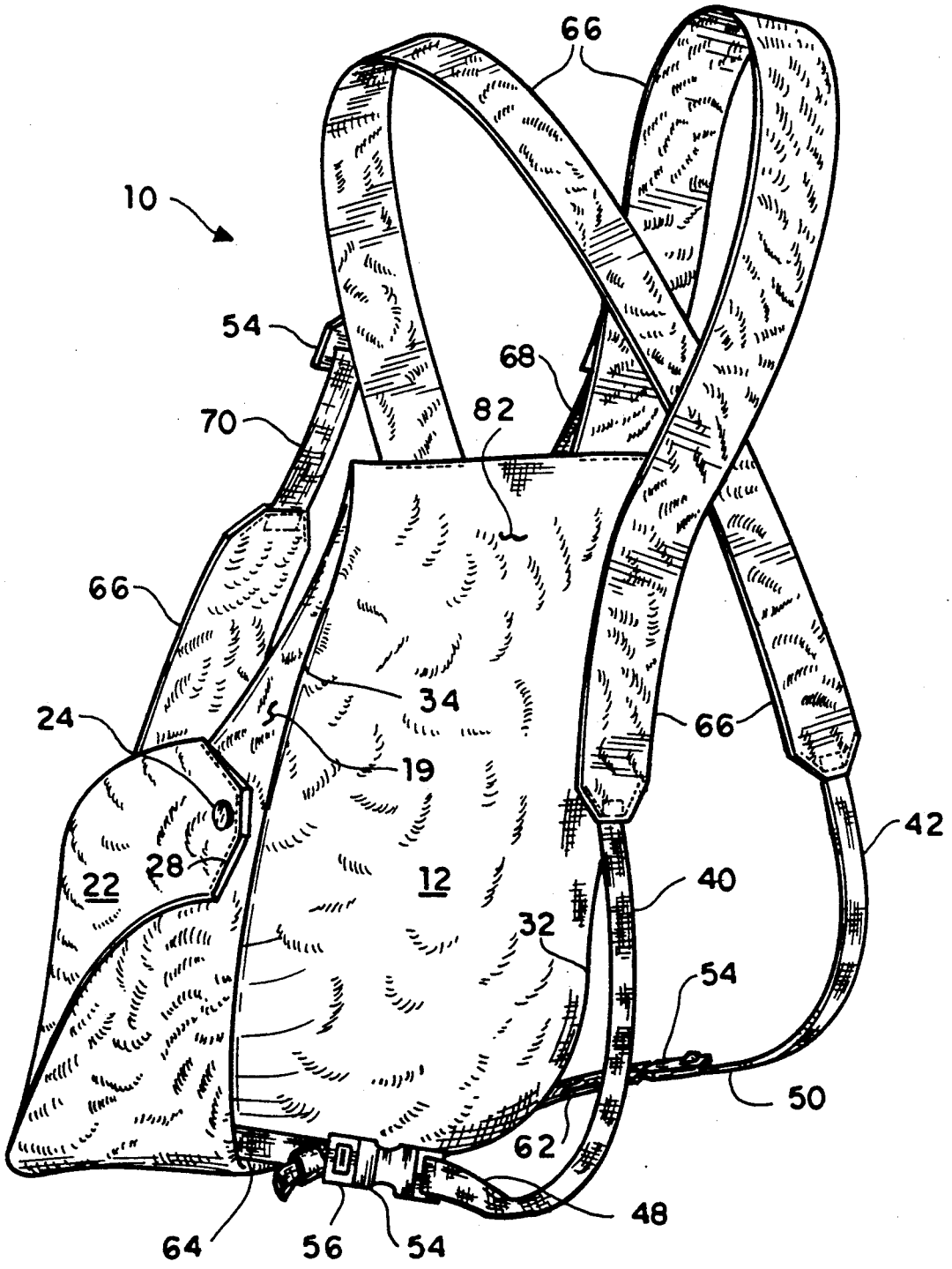
FIG. 2 is a rear perspective view, showing further details of the device.
Figure 3:
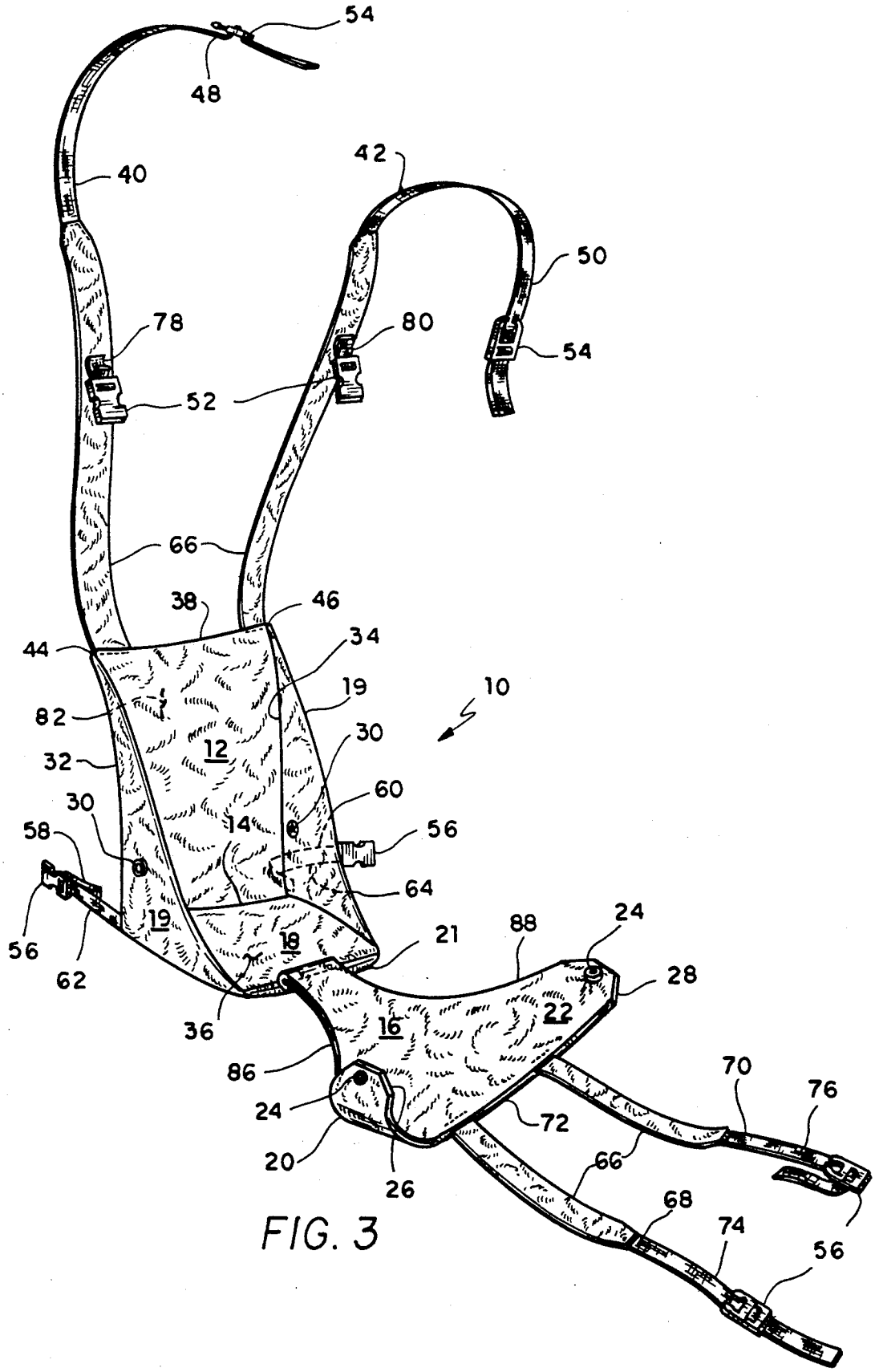
FIG. 3 is a perspective view of the device as it would be opened with the various straps and attachments extended.

Referring now to the drawings, particularly FIG. 1 of the drawings, the present invention will be seen to relate to a carrier 10 for the carriage of an infant or small child I by an adult A, in order to allow the hands of the adult A to remain free to accomplish various light chores. Carrier 10 will be seen to provide for the carriage of an infant or small child I at the front of the adult A, in such a manner that the infant or child I is facing in the same direction as the adult A rather than toward the adult A.

The primary component of carrier 10 is a flexible planar central member 12, to which various securing straps are attached. Central member 12 will be seen to be disposed between the back of the infant or child 1 and the front of adult A when carrier 10 is in use. Central member 12 is joined at its lower edge 14 to a generally horizontal seat 18, which seat 18 is supported by first and second side supports 19 which extend respectively from the first edge 32 and second edge 34 of central member 12.

The forward edge 21 of seat 18 provides an attachment point for a relatively narrow frontal restraint 16, which restraint 16 will be seen to pass between the legs of an infant carried within carrier 10 when carrier 10 is in use. Frontal restraint 16 extends upward to form a first lateral restraint 20 and a second lateral restraint 22.

Lateral restraints 20 and 22 will be seen to pass to either side of an infant or child I when carrier 10 is in use, thus serving to more securely contain an infant or child I within carrier 10 while carrier 10 is in use. Restraints 20 and 22 will be seen to include fasteners 24 near their respective distal ends 26 and 28, which fasteners 24 cooperate with mating fasteners 30 secured to first and second side supports 19.

Portions 12 through 22 of carrier 10 are preferably formed of a relatively flexible and pliable planar material, such as a liquid and stain resistant synthetic fabric material. Polyethylene and/or other synthetic fabric materials may be used, or alternatively natural fabrics such as cotton may be used in the construction of carrier 10 if desired. However, it is of primary importance that the material used be relatively flexible and durable.

It is of further importance to ensure adequate padding for carrier 10. Preferably, at least the seat 18 is provided with padding 36 in the present invention, in order to preclude any chafing or other injury to the infant or child I carried therein, and also to permit such an infant or child I to be carried within carrier 10 for relatively long periods of time, if necessary, without undue discomfort. Such padding 36 is preferably formed of a relatively plush synthetic wool material or the like, but may take other forms as desired such as open or closed cell foam plastic materials with a suitable fabric or other soft, pliable overlay. Such padding 36 may be provided over the entire area of portions 12 through 22 of carrier 10 if desired, and in many cases such extensive padding may be preferable.

The upper edge 38 of central member 12 provides attachment for first and second shoulder straps 40 and 42, which shoulder straps 40 and 42 pass over each shoulder S of adult A when carrier 10 is in use. It will be seen that the upper edge 38 of central member 12 is somewhat narrower than the remaining portion of central member 12, in order to provide adjacent attachment points 44 and 46 for shoulder straps 40 and 42. The adjacent attachment points 44 and 46 of straps 40 and 42 provide greater security for carrier 10, in that such adjacent attachment points 44 and 46 tend to better restrain straps 44 and 46 and preclude their lateral slippage from the shoulders S of adult A.

Shoulder straps 40 and 42 have distal ends 48 and 50, which ends 48 and 50 include positive latching buckles 54. Positive latching buckles 54 cooperate with mating adjustable buckles 56 which are secured to the distal ends 58 and 60 of lateral straps 62 and 64. Shoulder straps 40 and 42 are also provided with padding 66 in order to permit an adult A to carry an infant or child I in carrier 10 for relatively long periods of time, if necessary, without undue discomfort.

Infant or child restraining straps 68 and 70 are secured to the upper edge 72 of lateral restraints 20 and 22 near the center of upper edge 72 and essentially adjacent one another, in order to provide greater security in the manner of the adult shoulder straps 40 and 42 discussed above. Infant straps 68 and 70 are also equipped with adjusting buckles 56 at their respective distal ends 74 and 76 and padding 66 in the manner of shoulder straps 40 and 42. Infant restraining straps 68 and 70 secure respectively to upper infant or child restraining straps 78 and 80, which upper straps 78 and 80 are permanently secured to shoulder straps 40 and 42 at points above shoulder strap attach points 44 and 46. Upper straps 78 and 80 are also equipped with positive latching buckles 52, in the manner of shoulder straps 40 and 42.

The various straps 40, 42, 62, 64, 68, 70, 78, and 80 are preferably constructed of a relatively sturdy synthetic fabric webbing material one inch in width, although obviously other suitable materials may be used. The material presently used for the above straps is rated at 4500 pounds tensile strength. Adjustment buckles 56 and cooperating latching buckles 52 and 54 are also preferably of a relatively durable construction and provide slip proof securing of the various straps to which they are attached. The buckles used in the prototype of the present invention are the model SR 1 manufactured by the ITW Nexus Corporation, and are rated for a minimum load of 200 pounds each; again, a number of suitable equivalent buckles may be substituted. While many of the features of the carrier 10 of the present invention provide more strength and security than that absolutely required for the carriage of a 15 to 20 pound infant or child I, it will be understood that some safety margin should be provided to allow for wear and tear. Further, instantaneous shock loads, such as those achieved during each step while walking, will exceed the normal load of an infant or child I in carrier 10 at rest.

Carrier 10 is used by first securing carrier 10 to the adult A to be supporting carrier 10. The back surface 82 is placed adjacent to the front of the adult A to be carrying carrier 10, and first shoulder strap 40 is passed over one shoulder S of the adult A, wrapped diagonally across the back of the adult A, and secured to second lateral strap 64 with cooperating buckles 54 and 56. Second shoulder strap 42 is secured in a similar manner to first lateral strap 62. The fit of carrier 10 may be adjusted by means of adjustment buckles 56 on lateral straps 62 and 64.

Fasteners 24 in lateral restraint distal ends 26 and 28 may then be secured to respective mating fasteners 30 on first and second side supports 19, if this step has not been accomplished earlier. The completion of this step will secure the seat 18 and leg openings 84 defined by the forward edges of side supports 19, the forward edge 21 of seat 18 and narrowed portion 16 extending therefrom, and lower edges 86 and 88 respectively of first and second lateral restraints 20 and 22.

The infant or child I may then be placed facing forward within the seat 18 formed by the above assembly, with the legs L of the infant or child I extended through the leg openings 84. Holding the infant or child I with one arm, the adult A may then in turn secure each of the infant restraining straps 68 and 70 to their respective upper straps 78 and 80 by means of cooperating buckles 52 and 56, in the manner described above for shoulder straps 40 and 42 and lateral straps 62 and 64. However, first infant restraining strap 68 is secured to first upper strap 78 while second infant restraining strap 70 is secured to second upper strap 80, thus causing each strap 68 and 70 to remain to its respective side of carrier 10, rather than being secured diagonally in the manner of shoulder straps 40 and 42 and lateral straps 62 and 64. Adjustment is provided by means of adjustment buckles 56 installed upon restraining straps 68 and 70.

The carrier 10 described above provides for relative security for an infant or small child I secured therein when an adult A using carrier 10 is walking, shopping, or performing other tasks of a similar nature which do not produce sudden movements or otherwise expose the infant or child I secured therein to hazard. The strength provided by the webbing material used for the various straps described above provides a large safety factor, even when wear and tear and instantaneous loads are considered.

Moreover, the restraining system for the infant or child I secured therein comprises a five way restraint, consisting of first and second lateral restraints 20 and 22, first and second infant restraining straps 68 and 70, and frontal restraint 16. It is generally recognized that a five way restraint system provides the maximum possible security for a person using such a system.

The buckles 52, 54 and 56 provided not only allow for adjustment of the length of the various straps for optimum restraint and comfort, but also provide for positive latching in order to further assure security. Other arrangements, such as D rings which are known in the art, are prone to loosening and slippage, particularly when the strain is removed temporarily as when such a carrier is momentarily placed upon a surface to remove the weight of the infant or child from the straps.

Additionally, the padding 36 and 66 respectively provided for seat 18 and the various straps serve to ensure that an infant or child I carried within suffers no undue discomfort from being carried over a period of time, and further that chafing or other injury from the edges of straps 68 and 70 or leg openings 84 is precluded due to the padding provided. The numerous safety and security features thus provided by the present invention serve to provide substantial improvements over the prior art.

It is to be understood that the present invention is not limited to the sole embodiment described above, but encompasses any and all embodiments within the scope of the following claims.

I claim:

1. A carrier for the forward facing carriage of an infant or small child, said carrier temporarily securable to the front of an adult and comprising:

a central member formed of a pliable planar material and having a rear surface, first and second edges and an upper edge;

a seat extending forwardly therefrom opposite said upper edge with said seat laterally supported by first and second side supports extending respectively from said central member first and second edges;

a frontal restraint extending forwardly from said seat;

first and second lateral restraints having a common upper edge, wherein an end of said first lateral end is located nonadjacent an end of said second lateral restraint, and wherein said first and second lateral restraints extend from either side to said frontal restraint;

first and second shoulder straps extending from said central member upper edge and being secured adjacent one another;

first and second lateral straps extending from said central member;

first and second infant restraining straps extending from said upper edge of said lateral restraints and secured adjacent one another;

first and second upper infant restraining straps respectively secured to said first and second shoulder straps;

means for adjusting the length of said shoulder straps and said infant restraining straps and for temporarily and positively securing said shoulder straps to said lateral straps and said infant restraining straps to said upper infant restraining straps; and means for securing said end of said first lateral restraint and said end of said second lateral restraint to said first and second side supports, respectively, whereby said central member rear surface is placed adjacent said front of the adult, said first shoulder strap is passed over a shoulder and diagonally across the back of the adult and secured to said second lateral strap, said second shoulder straps is passed over an opposite shoulder and diagonally across the back of the adult and secured to said first lateral strap, said end of said first lateral restraint and said end of said second lateral restraint securing means are respectively secured to said first and second side supports to form leg openings for the infant, the infant is placed within said carrier facing forward with the legs of the infant extending through said leg openings, and said first and second infant restraining straps are respectively secured to said first and second upper infant restraining straps, thereby providing a five way infant restraint system comprised of said first and second infant restraining straps, said first and second lateral restraints, and said frontal restraint.

2. The infant carrier of claim 1 including;
padding disposed over at least said seat.

3. The infant carrier of claim 1 including;
padding disposed along said first and second shoulder straps.

4. The infant carrier of claim 1 including;
padding disposed along said first and second restraining straps.

5. The infant carrier of claim 1 wherein;
said means for temporarily and positively securing said shoulder straps to said lateral straps and said infant restraining straps to said upper infant restraining straps comprise positive latching buckles.

6. The infant carrier of claim 5 wherein;
said buckles are adjustable.

* * * * *